US012753520B2

(12) United States Patent
Kim et al.

(10) Patent No.: US 12,753,520 B2
(45) Date of Patent: Oct. 6, 2026

(54) MEMBRANE ELECTRODE ASSEMBLY FOR PEM WATER ELECTROLYSIS CAPABLE OF IMPROVING THE ELECTRICAL CONDUCTIVITY OF THE ELECTRODE LAYER AND METHOD OF MANUFACTURING THEREOF

(71) Applicant: KOREA INSTITUTE OF ENERGY RESEARCH, Daejeon (KR)

(72) Inventors: Sang Kyung Kim, Daejeon (KR); Won Chul Cho, Incheon (KR); Hyun Seok Cho, Sejong-si (KR); Min Joong Kim, Sejong-si (KR); Chang Soo Lee, Daejeon (KR); Jae Hun Lee, Daejeon (KR); Se Chan Lee, Cheongju-si (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 709 days.

(21) Appl. No.: 18/090,122

(22) Filed: Dec. 28, 2022

(65) Prior Publication Data

US 2023/0203679 A1 Jun. 29, 2023

(30) Foreign Application Priority Data

Dec. 29, 2021 (KR) ..... 10-2021-0191365

(51) Int. Cl.
*C25B 9/23* (2021.01)
*C25B 1/04* (2021.01)
(Continued)

(52) U.S. Cl.
CPC ..... *C25B 9/23* (2021.01); *C25B 1/04* (2013.01); *C25B 11/065* (2021.01); *C25B 11/081* (2021.01); *C25B 13/08* (2013.01)

(58) Field of Classification Search
CPC ..... C25B 9/23; C25B 1/04; C25B 11/065; C25B 11/081; C25B 13/08; C25B 11/054; C25B 9/13; C25B 11/093; Y02E 60/36
See application file for complete search history.

(56) References Cited

U.S. PATENT DOCUMENTS

2005/0205128 A1* 9/2005 Deng ..... C25B 1/55 429/111
2020/0131657 A1* 4/2020 Park ..... C25B 1/04
(Continued)

FOREIGN PATENT DOCUMENTS

JP 8-158059 A 6/1996
JP 9-165690 A 6/1997
(Continued)

OTHER PUBLICATIONS

Wittstadt, et al., "Membrane electrode assemblies for unitised regenerative polymer electrolyte fuel cells", 2005, Journal of Power Sources, 145, 555-562 (Year: 2005).*
(Continued)

*Primary Examiner* — Patrick S Ott
(74) *Attorney, Agent, or Firm* — Birch, Stewart, Kolasch & Birch, LLP

(57) ABSTRACT

Disclosed herein is a method for fabricating a membrane-electrode assembly for PEM water electrolysis, whereby the electrode layer can be improved in electrical conductivity. Specifically, a membrane-electrode assembly for PEM water electrolysis, comprising: a polymer electrolyte membrane; an anode disposed on one surface of the polymer electrolyte membrane and containing an anode catalyst; a cathode disposed on another surface of the polymer electrolyte membrane and containing a cathode catalyst; and a platinum layer disposed on the anode, and a fabrication method therefor are provided.

2 Claims, 2 Drawing Sheets

(51) Int. Cl.

| | |
|---|---|
| ***C25B 11/065*** | (2021.01) |
| ***C25B 11/081*** | (2021.01) |
| ***C25B 13/08*** | (2006.01) |

(56) References Cited

U.S. PATENT DOCUMENTS

| | | | | |
|---|---|---|---|---|
| 2020/0208277 | A1* | 7/2020 | Kim | C25B 11/089 |
| 2024/0141520 | A1* | 5/2024 | Kim | C25B 9/75 |

FOREIGN PATENT DOCUMENTS

| | | | |
|---|---|---|---|
| JP | 2013-82999 | A | 5/2013 |
| KR | 10-0908780 | B1 | 7/2009 |
| KR | 10-2020-0047279 | A | 5/2020 |
| KR | 10-2262416 | B1 | 6/2021 |

OTHER PUBLICATIONS

Lee, et al., "Development of porous Pt/IrO2/carbon paper electrocatalysts with enhanced mass transport as oxygen electrodes in unitized regenerative fuel cells", 2016, Electrochemistry Communications, 64, 14-17 (Year: 2016).*

Korean Notice of Allowance for Korean Application No. 10-2021-0191365, dated Jan. 20, 2024.

Korean Office Action (including an English translation thereof) issued in the corresponding Korean Patent Application No. 10-2021-0191365 on Nov. 9, 2023.

* cited by examiner

MEMBRANE ELECTRODE ASSEMBLY FOR PEM WATER ELECTROLYSIS CAPABLE OF IMPROVING THE ELECTRICAL CONDUCTIVITY OF THE ELECTRODE LAYER AND METHOD OF MANUFACTURING THEREOF

CROSS REFERENCE TO RELATED APPLICATIONS

This non-provisional application claims the benefit under 35 U.S.C. § 119(a) to Patent Application No. 10-2021-0191365, filed in Republic of Korea on Dec. 29, 2021, all of which are hereby expressly incorporated by reference into the present application.

BACKGROUND OF THE INVENTION

1. Field of the Invention

The present disclosure relates to a method for fabricating a membrane-electrode assembly for PEM water electrolysis, whereby an electrode layer can be improved in electrical conductivity, and a membrane-electrode assembly for PEM water electrolysis, fabricated thereby, having improved performance.

2. Description of the Prior Art

Hydrogen is expected to play a very important role as a future energy storage medium. With the use of infinite energy sources and non-polluting sustainable renewable energy, energy storage will arise as an important issue, and hydrogen is currently positioned as an alternative. Hydrogen is evaluated as a very valuable material that can be replaced as a fuel without the emission of harmful substances in all areas where conventional fossil fuels are used. Conversion of renewable energy into hydrogen energy is being studied in various ways among which electrolysis of water accounts for one of the most important methods.

In particular, polymer electrolyte water electrolysis is considered to be a promising technology because it is advantageous over conventional alkaline water electrolysis due to its ability to produce a high purity of hydrogen at a high current density in a highly energy efficient manner with neither a need of electrolyte management nor use of any compressor.

Polymer electrolyte membrane water electrolysis (hereinafter referred to as "PEM water electrolysis) technology is a method for electrolysis of water in a cell equipped with a proton-exchange membrane as a solid polymer electrolyte responsible for the conduction of protons. A membrane electrode assembly (MEA) is one of the most important components for PEM water electrolysis and consists of an anode, a cathode, and a polymer electrolyte membrane.

A membrane-electrode assembly (MEA) in which an electrochemical reaction occurs is a component that can have an important effect on the performance of water electrolysis, and a lot of research is being conducted to optimize the membrane-electrode assembly to secure excellent performance.

Catalysts such as platinum, iridium, or ruthenium are used in the catalyst layer of the membrane-electrode assembly. However, when the amount of the catalyst used is small, there is a problem that electrical conductivity is reduced. Therefore, it is necessary to develop a technology that can solve this problem.

RELATED ART DOCUMENT

Patent Literature

Korean Patent No. 10-2262416
Korean Patent No. 10-0908780

SUMMARY OF THE INVENTION

Leading to the present disclosure, thorough and intensive research conducted by the present inventors into a membrane-electrode assembly for PEM water electrolysis, with the aim of solving the problem of decreasing in electrical conductivity with a decrease of the catalyst amount in the anode catalyst layer, resulted in the finding that when a platinum coat on the anode catalyst layer in a membrane-electrode assembly can enhance the electrical conductivity of the electrode layer even when the amount of the catalyst is small.

Therefore, an aspect of the present disclosure is to provide a membrane-electrode assembly for PEM water electrolysis, including: a polymer electrolyte membrane; an anode disposed on one surface of the polymer electrolyte membrane and including an anode catalyst; a cathode disposed on the other surface of the polymer electrolyte membrane and including a cathode catalyst; and a platinum layer disposed on the surface of the anode.

Another aspect of the present disclosure is to provide a method for fabricating the membrane-electrode assembly for PEM water electrolysis.

According to an aspect thereof, the present disclosure provides a membrane-electrode assembly for PEM water electrolysis, including: a polymer electrolyte membrane; an anode disposed on one surface of the polymer electrolyte membrane and containing an anode catalyst; a cathode disposed on the other surface of the polymer electrolyte membrane and containing a cathode catalyst; and a platinum layer disposed on the surface of the anode.

In an embodiment of the present disclosure, the anode catalyst may be iridium oxide ($IrO_2$).

In an embodiment of the present disclosure, the cathode catalyst may be platinum-coated carbon powder (Pt/C).

In an embodiment of the present disclosure, the platinum layer may range in thickness from 20 to 100 nm.

Also, the present disclosure provides a method for fabricating a membrane-electrode assembly for PEM water electrolysis, the method including the steps of: (1) preparing an anode catalyst slurry containing an anode catalyst and an ion-conducting polymer and applying the anode catalyst slurry to a surface of a transfer film to construct an anode electrode; (2) preparing a cathode catalyst slurry containing a cathode catalyst and an ion-conducting polymer and applying the cathode catalyst slurry to a surface of a transfer film to construct a cathode electrode; (3) transferring the anode electrode and the cathode electrode to opposite surfaces of a polymer electrolyte membrane, respectively; and (4) coating the anode electrode with platinum to form a platinum layer on the surface of the anode electrode.

In an embodiment of the present disclosure, the anode catalyst may be iridium oxide ($IrO_2$).

In an embodiment of the present disclosure, the cathode catalyst may be platinum-coated carbon powder (Pt/C).

In an embodiment of the present disclosure, the platinum layer may range in thickness from 20 to 100 nm.

In an embodiment of the present disclosure, the platinum layer may be formed by sputtering.

In an embodiment of the present disclosure, the sputtering may be argon sputtering.

In an embodiment of the present disclosure, the ion-conducting polymer may be a cation-conducting ionomer.

Structured to include an anode coated with platinum by sputtering, the membrane electrode assembly for PEM water electrolysis, fabricated according to the method of the present disclosure, can solve the problem of decreasing in electrical conductivity with a decrease of the amount of the anode catalyst and can reduce the amount of the anode catalyst, without reducing the electrical conductivity, with the consequent effect of maximizing economic benefits, improving the electrical conductivity of the electrode layer, and efficiently producing hydrogen.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF THE EXEMPLARY EMBODIMENTS

Figure 1:
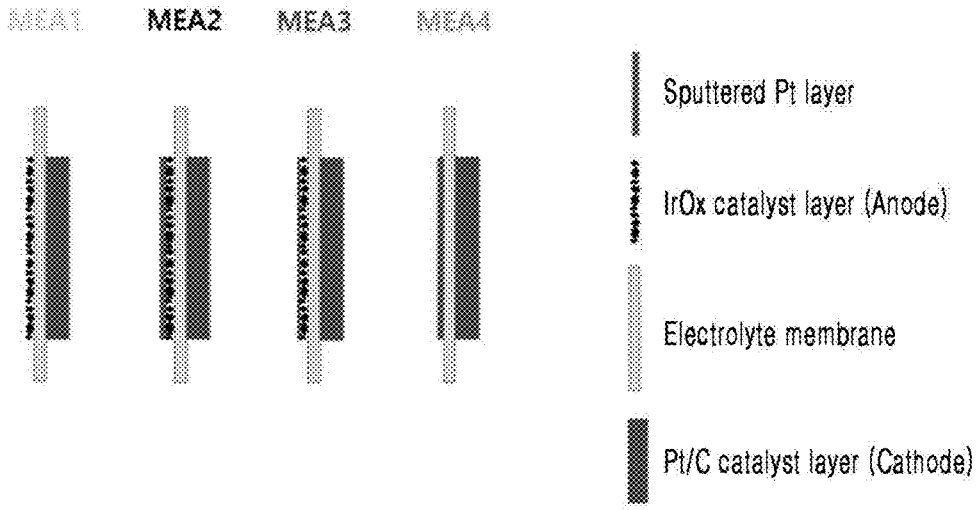
FIG. 1 shows structures of membrane-electrode assemblies for PEM water electrolysis, fabricated according to embodiments of the present disclosure and comparative embodiments.

The present disclosure provides a membrane-electrode assembly for PEM water electrolysis, with electrical conductivity improved in the electrode layer thereof. Specifically, the present disclosure provides a membrane-electrode assembly for PEM water electrolysis, including: a polymer electrolyte membrane; an anode disposed on one surface of the polymer electrolyte membrane and including an anode catalyst; a cathode disposed on the other surface of the polymer electrolyte membrane and including a cathode catalyst; and a platinum layer disposed on the surface of the anode.

As used herein, the term "PEM water electrolysis" refers to a technique of acquiring oxygen and hydrogen by electrolyzing water in a cell equipped with a polymer electrolyte membrane that serves as an electrolyte and a separator. Generally, a membrane-electrode assembly for PEM water electrolysis is composed of an anode, a cathode, and an ion exchange membrane responsible for the separation of the product gases hydrogen and oxygen and the conduction of protons from the anode to the cathode.

Such membrane-electrode assemblies for PEM water electrolysis decrease in electrical conductivity with decreasing of the amount of the anode catalyst. In order to solve the problem, research conducted by the present inventors culminated in the finding that an additional platinum coat on the anode surface can be a solution to the problem of reducing electrical conductivity with decreasing of the anode catalyst amount, thereby improving electrical conductivity in the electrode layer.

Therefore, the present disclosure is characterized by provision of a membrane-electrode assembly for PEM water electrolysis wherein the electrode layer including a platinum layer on the anode has improved electrical conductivity.

The membrane-electrode assembly for PEM water electrolysis according to the present disclosure includes a polymer electrolyte membrane. As used herein, the term "polymer electrolyte membrane", also called proton-exchange membrane, refers to a membrane made from a polymer designed to conduct protons. The membrane is disposed between an anode and a cathode in a water electrolysis device, serving as a passage for protons while acting as an electronic insulator and reactant barrier, e.g., to oxygen and hydrogen gas. It may be made from a fluoropolymer or a hydrocarbon polymer.

By way of example, the hydrocarbon polymer may be selected from among sulfonated polysulfone, sulfonated polyethersulfone, sulfonated poly(ether ketone), sulfonated poly(ether ether ketone), sulfonated poly(arylene ether ether ketone), sulfonated poly(arylene ether sulfone), sulfonated poly(arylene ether benzimidazole, and a combination thereof. Examples of the fluoropolymer include polyvinylidene fluoride (PVDF), polyvinylfluoride (PVF), polytetrafluoroethylene (PTFE), fluorinated ethylene-propylene (FEP), and a combination thereof.

In an embodiment of the present disclosure, Nafion (DuPont, USA), which is one of the most common fluoropolymers, is used as the polymer electrolyte membrane.

In addition, the membrane-electrode assembly for PEM water electrolysis according to the present disclosure includes an anode, that is, anode electrode, which is deposed on one surface of the polymer electrolyte membrane and contains an anode catalyst.

The anode catalyst catalyzes an oxygen evolution reaction (OER) in a PEM water electrolysis apparatus and may be made from at least one selected from the group consisting of platinum, ruthenium, iridium, osmium, palladium, a platinum-ruthenium alloy, a platinum-osmium alloy, a platinum-palladium alloy, and an oxide thereof, for example, iridium oxide ($IrO_2$).

Furthermore, the membrane-electrode assembly for PEM water electrolysis includes a cathode, that is, cathode electrode, which is deposed on one surface of the polymer electrolyte membrane and contains a cathode catalyst.

The cathode catalyst catalyzes a hydrogen evolution reaction (HER) in a PEM water electrolysis apparatus and may be made from at least one selected from the group consisting of platinum, ruthenium, iridium, osmium, palladium, a platinum-ruthenium alloy, a platinum-palladium alloy, and an oxide thereof. In an embodiment of the present disclosure, platinum-coated carbon powder (Pt/C) is employed.

Moreover, the membrane-electrode assembly for PEM water electrolysis according to the present disclosure includes a platinum layer disposed on the surface of the anode.

On the anode, the platinum layer is formed at a thickness of 20-100 nm and preferably at a thickness of 40-80 nm, using a sputtering method and preferably an argon sputtering method.

The membrane-electrode assembly for PEM water electrolysis including a platinum layer disposed on an anode according to an embodiment of the present disclosure is structure as illustrated in FIG. 1.

By the present inventors, the membrane-electrode assembly for PEM water electrolysis including a platinum layer disposed on an anode was analyzed for performance. As a result, when constructed with a reduced amount of an iridium oxide catalyst, a conventional membrane-electrode assembly was observed to become poor in PEM water electrolysis performance due to the low load of the catalyst whereas the membrane-electrode assembly of the present disclosure exhibited excellent PEM water electrolysis performance, with the concomitant appearance of a high electrochemical activity peak and area in the anode catalyst.

Also, the present disclosure provides a method for fabricating a membrane-electrode assembly for PEM water electrolysis, the method including the steps of: (1) preparing an anode catalyst slurry containing an anode catalyst and an ion conducting polymer and applying the anode catalyst slurry to a surface of a transfer film to construct an anode electrode; (2) preparing a cathode catalyst slurry containing a cathode catalyst and an ion-conducting polymer and applying the cathode catalyst slurry to a surface of a transfer film to construct a cathode electrode; (3) transferring the anode electrode and the cathode electrode to opposite surfaces of a polymer electrolyte membrane, respectively; and (4) coating the anode electrode with platinum to form a platinum layer on the surface of the anode electrode.

In detail, the fabrication of the membrane-electrode assembly for PEM water electrolysis according to the present disclosure may be achieved by preparing an anode catalyst slurry containing an anode catalyst and an ion conducting polymer and coating a transfer film with the anode catalyst slurry to form an anode electrode.

In this regard, the anode catalyst may be made from at least one selected from the group consisting of platinum, ruthenium, iridium, osmium, palladium, a platinum-ruthenium alloy, a platinum-osmium alloy, a platinum-palladium alloy, and an oxide thereof, for example, iridium oxide ($IrO_2$), but with no limitations thereto.

In an embodiment of the present disclosure, iridium oxide ($IrO_2$) a catalyst powder, water, isopropyl alcohol, and a Nafion ionomer were mixed to prepare an anode catalyst slurry, followed by applying the slurry to a PTFE film.

Separately from the construction of the anode electrode, a cathode electrode is constructed by preparing a cathode catalyst slurry containing a cathode catalyst and an ion conducting polymer and coating a transfer film with the cathode catalyst slurry.

The cathode catalyst may be made from at least one selected from the group consisting of platinum, ruthenium, iridium, osmium, palladium, a platinum-ruthenium alloy, a platinum-osmium alloy, a platinum-palladium alloy, and an oxide thereof and preferably from a platinum-coated carbon powder (Pt/C), but with no limitations thereto.

In an embodiment of the present disclosure, a platinum-coated carbon (Pt/C) catalyst powder, water, isopropyl alcohol, and a Nafion ionomer were mixed to prepare a cathode catalyst slurry which was then applied to a PTFE film.

So long as it is typically employed in the art, any coating method may be available for coating a transfer film with the anode catalyst or the cathode catalyst. The coating may be performed using one selected from the group consisting of spray coating, screen printing, tape casting, brushing, and slot die casting, but with no limitations thereto.

Subsequently, the anode electrode and the cathode electrode are transferred to the opposite surfaces of the polymer electrolyte membrane, respectively.

Herein, the polymer electrolyte membrane is a membrane made from a polymer having a cation-exchanging group capable of transferring protons. The membrane is disposed between an anode and a cathode in a water electrolysis device, serving as a passage for protons. It may be made from a fluoropolymer or a hydrocarbon polymer.

For example, the hydrocarbon polymer may be selected from among sulfonated polysulfone, sulfonated polyethersulfone, sulfonated poly(ether ketone), sulfonated poly(ether ether ketone), sulfonated poly(arylene ether ether ketone), sulfonated poly(arylene ether sulfone), sulfonated poly (arylene ether benzimidazole, and a combination thereof, but with no limitations thereto. Examples of the fluoropolymer include, but are not limited to, polyvinylidene fluoride (PVDF), polyvinylfluoride (PVF), polytetrafluoroethylene (PTFE), fluorinated ethylene-propylene (FEP), and a combination thereof.

In addition, any transferring method known in the art may be available in the present disclosure. Used in an embodiment of the present disclosure is a decal transfer process, that is, a process of transferring a matter to a recipient by simultaneously applying heat and pressure thereto.

Afterward, a step of coating the anode electrode with platinum to form a platinum layer on the surface of the anode electrode is conducted.

In this regard, the formation of the platinum layer on the surface of the anode electrode may be achieved using a sputtering method. Preferably, a platinum layer 20-100 nm thick is formed using an argon sputtering method.

When the platinum layer is thicker than 100 nm, mass transfer resistance may occur, resulting in a decrease in performance at high current, and the thick platinum coating increases the price. With a thickness less than 20 nm, the platinum layer decreases in the electroconducting function. Thus, it is important to form the platinum layer at a thickness of 20-100 nm and preferably at a thickness of 40-80 nm.

In an embodiment of the present disclosure, a platinum layer 80 nm thick is formed using an argon sputtering method at 100 W for 10 minutes. In another embodiment, coating is performed through argon sputtering at 100 W for 5 minutes to form a platinum layer at a thickness of 40 nm.

Structured to have a platinum layer on the surface of an anode electrode, the membrane-electrode assembly of the present disclosure, as described above, can solve the problem of decreasing in electrical conductivity with a decrease of the catalyst amount in the anode catalyst layer and ultimately can improve the electrical conductivity and performance of the electrode layer.

A better understanding of the present disclosure may be obtained through the following examples which are set forth to illustrate, but are not to be construed as limiting the present disclosure.

Example 1

Fabrication of Membrane-Electrode Assembly Having Platinum-Coated Anode Catalyst Layer for PEM Water Electrolysis In order to improve electrical conductivity in the electrode layer thereof, a membrane-electrode assembly for PEM water electrolysis was fabricated as follows.

First, 0.3 g of an iridium oxide catalyst powder, 0.12 g of water, 0.68 g of isopropyl alcohol, and 0.224 g of a 20% Nafion dispersion were mixed to prepare an anode catalyst slurry which was then applied to a polytetrafluoroethylene (PTFE) film to form an anode. Separately, 0.1 g of 50% platinum/carbon (Pt/C) catalyst powder, 0.52 g of water, 1.1 g of isopropyl alcohol, and 0.1875 g of a 20% Nafion dispersion was mixed to prepare a cathode catalyst slurry which was then applied to a PTFE film to form a cathode. Subsequently, the anode and cathode films, both coated with the coating layer, were transferred to the opposite surfaces of a Nafion film, respectively.

Subsequently, the iridium oxide catalyst-coated anode catalyst layer was coated with platinum by an argon sputtering method. In this regard, the sputtering was conducted at 100 W for 10 minutes to form a platinum layer 80 nm thick. As a result, a membrane-electrode assembly for PEM water electrolysis (MEA2) according to the present disclosure, having a platinum layer additionally formed on an anode catalyst layer coated with an iridium oxide catalyst, was fabricated.

Example 2

Fabrication of Membrane-Electrode Assembly Having Platinum-Coated Anode Catalyst Layer for PEM Water Electrolysis A membrane-electrode assembly for PEM water electrolysis (MEA3) according to the present disclosure was fabricated in the same manner as in Example 1, with the exception that the iridium oxide catalyst-coated anode catalyst layer is coated with platinum by an argon sputtering method at 100 W for 5 minutes to form a platinum layer 40 nm thick.

Comparative Example 1

A membrane-electrode assembly for PEM water electrolysis (MEA1) was fabricated in the same manner as in Example 1, with the exception that the load of the iridium oxide catalyst was reduced to 0.5 $mg/cm^2$ in the iridium oxide catalyst layer (anode) and no argon sputtering methods for coating the iridium oxide catalyst-coated anode catalyst layer with platinum layer was conducted. That is, the MEA employed the same amount of the iridium oxide catalyst as in Example 1, with no additional platinum layer on the anode catalyst layer.

Comparative Example 2

A membrane-electrode assembly for PEM water electrolysis (MEA4) was fabricated in the same manner as in Example 1, with the exception that only a platinum layer was formed using an argon sputtering method, with no iridium oxide catalyst layers formed on the anode layer.

Structures of the membrane-electrode assemblies for PEM water electrolysis, fabricated in Examples 1 and 2 and Comparative Examples 1 and 2, are depicted in FIG. 1.

Experimental Example 1

Surface Analysis of Platinum Coat Formed by Sputtering

Scanning electron microscopy (SEM) was conducted to examine whether a platinum layer was formed on the iridium oxide catalyst-coated anode catalyst layer in the membrane-electrode assembly for PEM water electrolysis, fabricated in Example 1.

Figure 2:
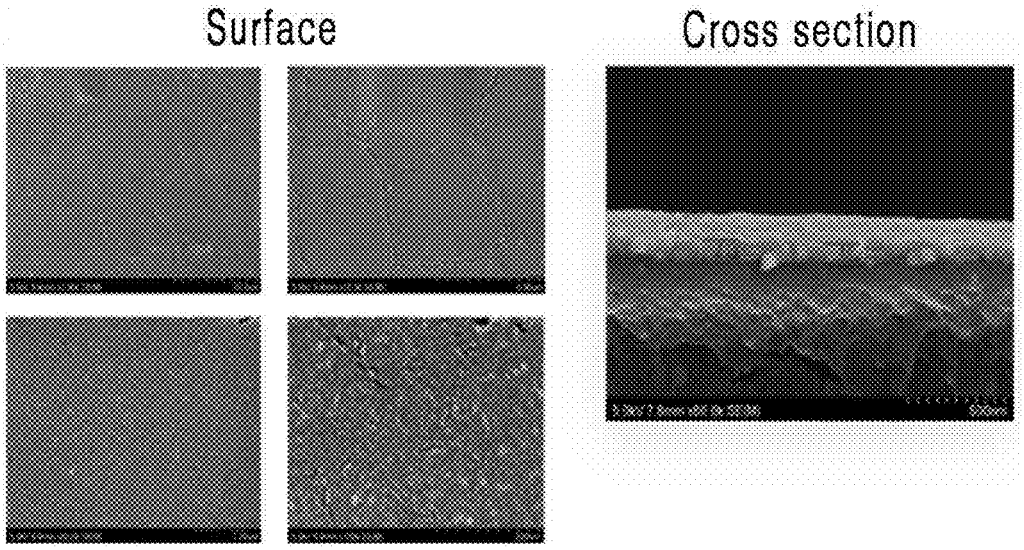
FIG. 2 shows scanning electron microscopic images of the surface and cross-section of a membrane-electrode assembly for PEM water electrolysis, fabricated by coating an anode catalyst layer with platinum according to an embodiment of the present disclosure.

As shown in the SEM image of FIG. 2, a platinum layer about 80 nm thick was observed to be well established on the anode catalyst of the Nafion electrolyte membrane.

Experimental Example 2

Performance Analysis of Membrane Electrode Assembly

The four membrane electrode assemblies fabricated in the Examples and Comparative Examples were all analyzed for performance. In this regard, a performance curve was obtained by measuring the voltage while increasing the current using a potentiostat in the condition of flowing water through the anode of the fabricated membrane electrode assembly (MEA).

Figure 3:
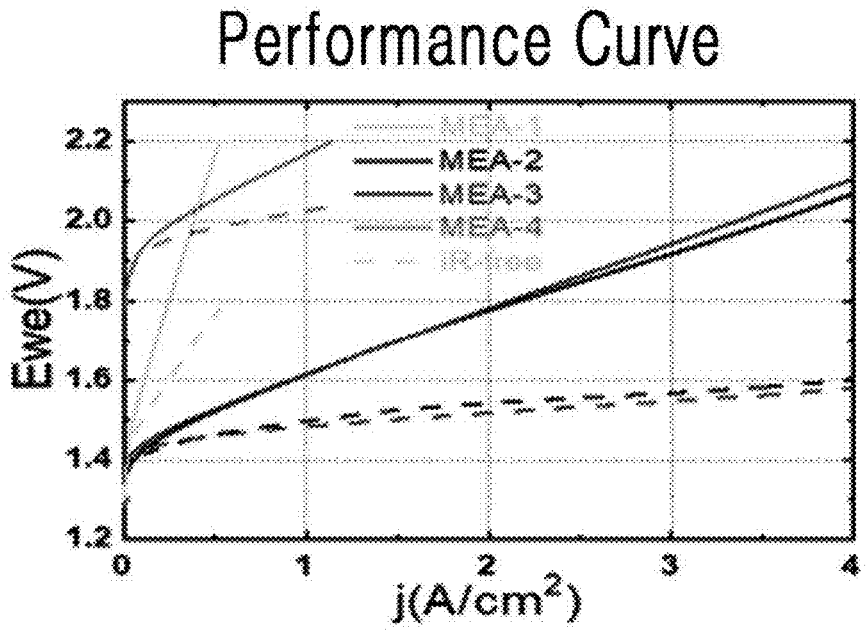
FIG. 3 shows performance analysis results of membrane-electrode assemblies for PEM water electrolysis fabricated according to embodiments of the present disclosure and comparative embodiments.

As shown in FIG. 3, the membrane electrode assembly (MEA-1) of Comparative Example 1, fabricated using a reduced amount of iridium oxide catalyst, was poor in PEM water electrolysis performance due to the low electrical conductivity resulting from the low load of the catalyst, and in the membrane electrode assembly (MEA-4) of Comparative Example 2, fabricated by coating the anode with only a platinum layer, without an iridium oxide catalyst layer, the anode did not catalytic performance at all.

In contrast, the membrane electrode assembly (MEA-2) of the present disclosure, fabricated by coating an anode catalyst layer with platinum at a thickness of 80 nm, was observed to have excellent PEM water electrolysis performance. Also, excellent PEM water electrolysis performance was detected in the membrane electrode assembly (MEA-3) of the present disclosure, fabricated by forming a platinum layer at a thickness of 40 nm.

From the data, it was understood that a membrane electrode assembly fabricated by coating an anode catalyst layer with platinum exhibits enhanced PEM water electrolysis performance and can overcome the problem of decreasing in electrical conductivity with the decrease of the catalyst amount in the anode catalyst layer.

Experimental Example 3

Electrochemical Evaluation of Membrane Electrode Assembly

The four membrane electrode assemblies fabricated in the Examples and Comparative Examples were all electrochemically evaluated. In this regard, measurement was made of the current generated by reversibly changing the voltage between 0 and 1.3 V in the fabricated membrane electrode assemblies while flowing water through the anode and hydrogen through the cathode.

Figure 4:
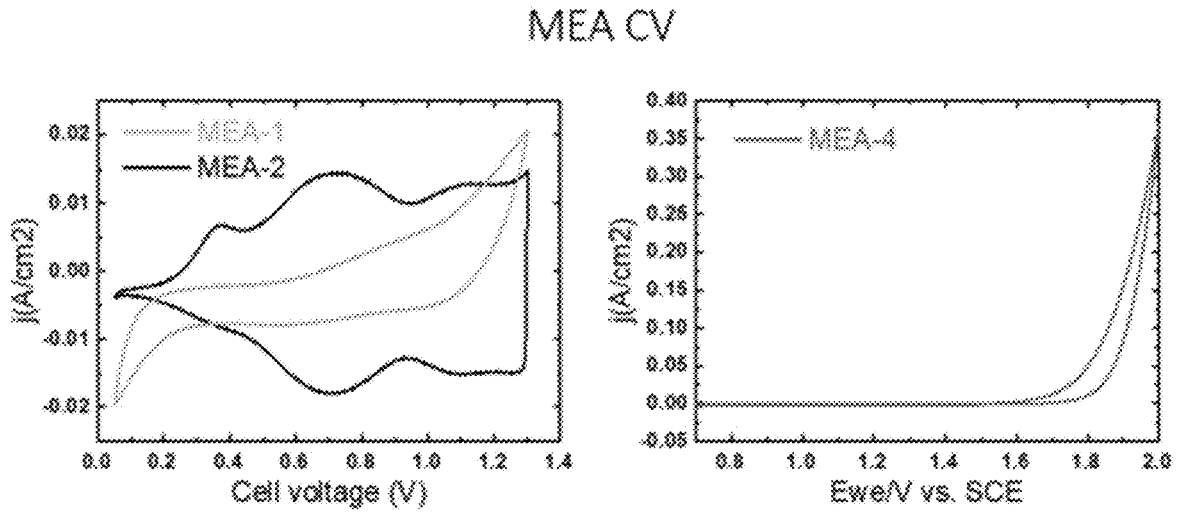
FIG. 4 shows electrochemical characteristics of membrane-electrode assemblies for PEM water electrolysis fabricated according to embodiments of the present disclosure and comparative embodiments.

The results are depicted in FIG. 4. In the membrane electrode assembly (MEA-1) of Comparative Example 1, fabricated with a reduced amount of iridium oxide catalyst, as shown in FIG. 4, the iridium oxide catalyst was observed to exhibit little electrochemical activity and a very small electrochemical activity area. In addition, electrochemical peaks associated with hydrolysis performance did not appear at all in the membrane electrode assembly (MEA-4) of Comparative Example 2, which was fabricated by forming only a platinum layer on the anode, without an iridium oxide catalyst layer.

As opposed, the iridium oxide catalyst in the membrane electrode assembly (MEA-2) having a platinum coat on an anode according to the present disclosure exhibited a distinctive electrochemical activity peak and a large electrochemical activity area.

Taken together, the data obtained above indicate that a platinum coat formed by sputtering on an anode catalyst layer in a membrane electrode assembly for water electrolysis can enhance the performance of the membrane electrode assembly and effectively solve the problem of decreasing in electrical conductivity with the decrease of the catalyst amount in the anode catalyst layer.

The preferred embodiments of the disclosure have been explained so far. a person skilled in the art will understand that the disclosure may be implemented in modifications without departing from the basic characteristics of the disclosure. Accordingly, the foregoing exemplary embodiments and advantages are merely exemplary and are not to be construed as limiting the present disclosure. The present teaching can be readily applied to other types of apparatuses. Also, the description of the exemplary embodiments of the present inventive concept is intended to be illustrative, and not to limit the scope of the claims.

What is claimed is:

1. A method for fabricating a membrane-electrode assembly for polymer electrolyte membrane (PEM) water electrolysis, the method comprising the steps of:

(1) preparing an anode catalyst slurry containing an anode catalyst and an ion-conducting polymer and applying the anode catalyst slurry to a surface of a transfer film to construct an anode electrode;

wherein the anode catalyst is iridium oxide ($IrO_2$);

(2) preparing a cathode catalyst slurry containing a cathode catalyst and an ion-conducting polymer and applying the cathode catalyst slurry to a surface of a transfer film to construct a cathode electrode;

wherein the cathode catalyst is platinum-coated carbon powder (Pt/C);

(3) transferring the anode electrode and the cathode electrode to opposite surfaces of a polymer electrolyte membrane, respectively; and (4) coating the anode electrode with platinum to form a platinum layer on a surface of the anode electrode by argon sputtering;

wherein a thickness of the platinum layer formed by the sputtering ranges from 40 to 100 nm.

2. The method of claim 1, wherein the ion-conducting polymer of either the anode catalyst slurry or cathode catalyst slurry is a cation-conducting ionomer.

* * * * *